US009595153B2

(12) United States Patent
Togiya

(10) Patent No.: US 9,595,153 B2
(45) Date of Patent: Mar. 14, 2017

(54) MEDIUM HANDLING APPARATUS

(75) Inventor: Hajime Togiya, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/127,338

(22) PCT Filed: May 31, 2012

(86) PCT No.: PCT/JP2012/064091

§ 371 (c)(1),
(2), (4) Date: Dec. 18, 2013

(87) PCT Pub. No.: WO2013/038758

PCT Pub. Date: Mar. 21, 2013

(65) Prior Publication Data

US 2014/0131164 A1 May 15, 2014

(30) Foreign Application Priority Data

Sep. 13, 2011 (JP) ..... 2011-199627

(51) Int. Cl.
*G07F 7/04* (2006.01)
*G07D 11/00* (2006.01)
(Continued)

(52) U.S. Cl.
CPC ..... *G07D 11/0012* (2013.01); *B65H 29/006* (2013.01); *B65H 5/00* (2013.01);
(Continued)

(58) Field of Classification Search
CPC ..... B65H 2701/1912; B65H 29/006; B65H 75/30; B65H 59/00; B65H 23/042; B65H 2403/72; B65H 2553/00; B65H 29/00; B65H 5/00; B65H 5/02; B65H 5/18; B65H 5/028; B65H 5/06; B65H 5/224; B65H 5/226; B65H 85/00; B65H 2553/80; B65H 7/00;
(Continued)

(56) References Cited

U.S. PATENT DOCUMENTS 4,589,603 A 5/1986 Muller
5,797,560 A * 8/1998 Kishi et al. ..... 242/528
(Continued)

FOREIGN PATENT DOCUMENTS

CN 1314298 A 9/2001
CN 1486917 A 4/2004
(Continued)

OTHER PUBLICATIONS

Russian Office Action with translation dated May 28, 2015.

*Primary Examiner* — Jeffrey Shapiro
(74) *Attorney, Agent, or Firm* — Rabin & Berdo, P.C.

(57) ABSTRACT

Tapes holding bills and wound round a drum are pressed against the drum by a winding roller, and the tapes are further pressed against the drum by a guide roller provided downstream of the winding roller in the tape winding direction of the drum. Thus, bills difficult to be curved along the outer circumferential surface of the drum, such as creased or wrinkled bills, can be curved along the outer circumferential surface of the drum, and the bills wound round the drum can be prevented from shifting or skewing.

17 Claims, 13 Drawing Sheets

(51) Int. Cl.

| | |
|---|---|
| ***B65H 29/00*** | (2006.01) |
| *B65H 75/30* | (2006.01) |
| *B65H 59/00* | (2006.01) |
| *B65H 23/04* | (2006.01) |
| *B65H 5/00* | (2006.01) |

(52) U.S. Cl.

CPC ..... *B65H 23/042* (2013.01); *B65H 59/00* (2013.01); *B65H 75/30* (2013.01); *B65H 2553/00* (2013.01); *B65H 2701/1912* (2013.01); *G07D 11/003* (2013.01); *G07D 11/0003* (2013.01); *G07D 11/0024* (2013.01); *G07D 11/0033* (2013.01); *G07D 11/0081* (2013.01); *G07D 11/0084* (2013.01); *G07D 11/0087* (2013.01); *G07D 2207/00* (2013.01); *G07D 2211/00* (2013.01)

(58) Field of Classification Search

CPC . B65H 7/02; B65H 7/20; B65H 29/66; B65H 29/6645; B65H 29/669; B65H 31/00; G07D 7/00; G07D 7/06; G07D 7/12; G07D 7/121; G07D 7/122; G07D 7/123; G07D 7/124; G07D 7/125; G07D 7/127; G07D 7/0006; G07D 7/0013; G07D 7/002; G07D 7/0026; G07D 7/0033; G07D 7/004; G07D 11/0012; G07D 7/0046; G07D 7/0053; G07D 7/006; G07D 7/0066; G07D 7/0073; G07D 7/008; G07D 7/0086; G07D 7/20; G07D 7/205; G07D 7/2058; G07D 7/2008; G07D 7/2016; G07D 7/2025; G07D 7/2033; G07D 7/2041; G07D 7/2066; G07D 11/0078; G07D 2211/00; G07D 2207/00

USPC ..... 242/412.2, 412, 428, 528, 3, 334, 410, 242/415, 415.1, 420.4, 611, 412.3; 194/206, 207; 209/534; 235/379; 382/135; 271/176, 216, 3.16, 3.21, 271/258.01, 259, 275; 270/60

See application file for complete search history.

(56) References Cited

U.S. PATENT DOCUMENTS

| | | | | |
|---|---|---|---|---|
| 6,834,808 | B2 | 12/2004 | Satou et al. | |
| 7,789,211 | B2 * | 9/2010 | Uemizo et al. | 194/206 |
| 8,162,308 | B2 * | 4/2012 | Kobayashi et al. | 270/60 |
| 8,302,757 | B1 * | 11/2012 | Angus et al. | 194/206 |
| 8,496,099 | B2 | 7/2013 | Togiya et al. | |
| 9,004,256 | B2 * | 4/2015 | Ohara et al. | 194/206 |
| 9,016,611 | B2 | 4/2015 | Tosaka et al. | |
| 2001/0022258 | A1 | 9/2001 | Satou et al. | |
| 2002/0096818 | A1 | 7/2002 | Mochizuki et al. | |
| 2002/0101023 | A1 | 8/2002 | Saltsov et al. | |
| 2003/0029959 | A1 * | 2/2003 | Fujiwara et al. | 242/528 |
| 2008/0128240 | A1 * | 6/2008 | Uemizo et al. | 194/206 |
| 2010/0100245 | A1 * | 4/2010 | Oishi et al. | 700/275 |
| 2010/0163571 | A1 * | 7/2010 | Mizoro | 221/71 |
| 2011/0073611 | A1 | 3/2011 | Tosaka et al. | |
| 2014/0131164 | A1 * | 5/2014 | Togiya | B65H 29/006 194/206 |

FOREIGN PATENT DOCUMENTS

| | | | |
|---|---|---|---|
| CN | 102044109 | A | 5/2011 |
| CN | 102066222 | A | 5/2011 |
| JP | 2001-118113 | A | 4/2001 |
| JP | 2001-266213 | A | 9/2001 |
| JP | 2006-069708 | A | 3/2006 |
| JP | 2008-123093 | A | 5/2008 |
| JP | 2010-006494 | A | 1/2010 |
| JP | 2011-002921 | A | 1/2011 |

* cited by examiner

MEDIUM HANDLING APPARATUS

TECHNICAL FIELD

The present invention relates to a medium handling apparatus, in particular, for example, to an automated teller machine for inserting media therein, such as bills, to make desired transaction.

BACKGROUND ART

As disclosed in Japanese patent laid-open publication No. 2011-2921, a conventional automated teller machine stores in a temporary storage bills deposited by customers to thereafter store them in cassettes according to denominations. The temporary storage winds the bills held between and conveyed by tapes round a drum together with the tapes to thereby store them.

If a bill should be creased or wrinkled, the bill may not be readily curved along the outer circumferential surface of the drum. Such a bill may hinder the tapes from being wound round the drum along the outer circumferential surface thereof and may cause a clearance between the tapes. Consequently, it has been the case that the tapes cannot hold down a bill wound just before that bill properly against the drum, which causes a fold, a jam, or breakage.

SUMMARY OF THE INVENTION

It is an object of the present invention to provide a medium handling apparatus capable of holding a medium in an orderly manner even when there be any medium which is hardly curved due to being creased or wrinkled.

In accordance with the present invention, a medium handling apparatus is adapted such that a winding roller presses against a drum tapes which hold a sheet-like medium to be conveyed and are wound round the drum, and further a guide roller provided downstream of the winding roller in the winding direction of the tapes on the drum presses the tapes against the drum.

In accordance with the present invention, a medium handling apparatus handling a sheet-like medium to be conveyed includes a tape holding the medium, a drum rotatably supported on a stationary part of the apparatus and having an outer circumferential surface to which one end of the tape is fixed for winding the tape round the outer circumferential surface while rotating, a movable unit supported on the stationary part separably from the outer circumferential surface and extending in the tape winding direction of the drum over a part of the outer circumferential surface with the tape running between the movable unit and the outer circumferential surface, a winding roller supported on the movable unit separably from the outer circumferential surface for pressing the tape against the drum, and a guide roller pressing the tape against the outer circumferential surface of the drum.

Thus, a sheet-like medium difficult to be curved, such as a creased bill or a wrinkled bill, can be curved along the outer circumferential surface of the drum. It is thus possible to prevent the medium wound round the drum from shifting or skewing.

BRIEF DESCRIPTION OF THE DRAWINGS

The objects and features of the present invention will become more apparent from consideration of the following detailed description taken in conjunction with the accompanying drawings in which.

BEST MODE FOR IMPLEMENTING THE INVENTION

Figure 1:
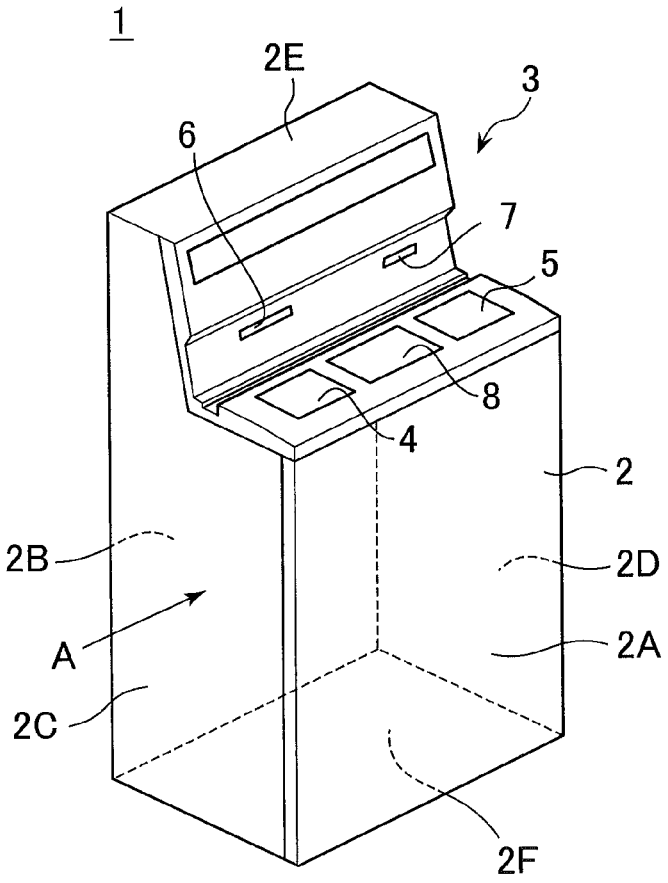
FIG. 1 is a perspective appearance view of an automated teller machine in accordance with the present invention, as seen from the front on the left thereof.

In the following, embodiments of a medium handling apparatus in accordance with the present invention will be described in detail with reference to the accompanying drawings. FIG. 1 shows an automated teller machine 1. The automated teller machine 1 is a medium handling apparatus which is installed, for example, in financial institutions, stores and booths of convenience stores and the like, and conducts cash transaction with customers to, for example, receive from or pay out to customers cash, such as bills or coins, according to the detail of transaction with customers.

Figure 2:
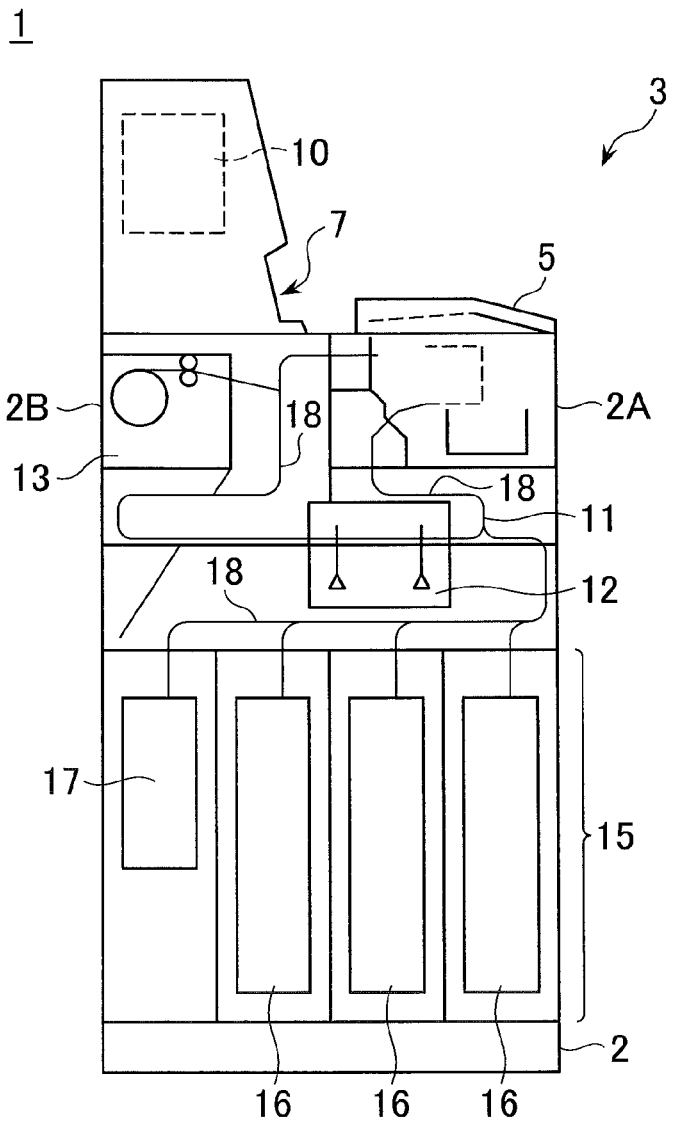
FIG. 2 is a conceptual view of the internal structure of the automated teller machine of FIG. 1, as seen from its left side.

In the automated teller machine 1, when a customer inserts a sheet-like medium, bills in the instant embodiment, into a bill deposit/withdrawal slot 5, FIG. 2, in deposit transaction, a validator 12 discriminates the bills inserted therein and then a temporary storage 13 stores the bills when discriminated as being a normal bill, whereas a bill, when discriminated as one not to be dealt, is sent back to the bill deposit/withdrawal slot and returned to the customer. Subsequently, in the automated teller machine 1, when the customer fixes the amount of deposit, the validator 12 discriminates the bills stored in the temporary storage 13 in terms of denomination and stores them in appropriate denomination cassettes 16 according to the discriminated denominations.

The automated teller machine 1 includes a box-like frame 2, which is provided with an openable and lockable door, not shown, on a certain wall thereof, such as its front face 2A or the opposite face thereto, i.e. its rear wall. The door is closed during transaction operation of conducting cash transaction with a customer to protect securities, such as cash, e.g. bills BL and coins in the instant embodiment, held inside the frame 2. By contrast, at the time of maintenance work where needed personnel, such as a service person, conducts maintenance work, the door can be opened as required, thereby making it possible to easily execute maintenance work for every part inside the frame 2.

The frame 2 has a customer service unit 3 provided at a place where the customer can easily perform deposition of bills or operation on its touch panel while he or she stands to face the front face 2A, i.e. at a place between the upper part of the front face 2A and the top face 2E.

The customer service unit 3 is an interface function unit, which receives and delivers a medium, such as cash or a passbook, directly from and to the customer, and presents information about the transaction to customers as well as receives operator guidance from customers. It includes a coin deposit/withdrawal section 4, a bill deposit/withdrawal section 5, a passbook receptacle 6, a card receptacle 7 and a display and operation unit 8.

The coin deposit/withdrawal section 4 and the bill deposit/withdrawal section 5 are mechanism into which coins and bills BL deposited by customers are inserted and also from which coins and bills BL to be paid out to customers are discharged. The coin deposit/withdrawal section 4 and the bill deposit/withdrawal section 5 include respective shutters and driving mechanisms for opening and closing the shutters, neither shown, so that opening and closing of the shutters cause the deposit/withdrawal section 4 and 5 to be accessed and shut off, respectively. Bills BL are an example of a sheet-like medium having its shape rectangular and flat.

The passbook receptacle 6 is a mechanism into which a passbook for use in transaction is inserted and from which the passbook is discharged after completion of the transaction. Inside the passbook receptacle 6 there is provided a passbook processor, not shown, for recording information about the detail of transaction on a passbook, for example, by printing, magnetically, or electronically.

The card receptacle 7 is a mechanism into which various types of cards, such as a cash card, are inserted and from which they are discharged. In the back of the card insert slot 7 there is provided a card processing part, not shown, for reading and recording transaction information, such as an account number recorded magnetically or electronically on a variety of cards.

The display and operation unit 8 in the embodiment is an interface function unit which includes a combination of a liquid crystal display (LCD) for displaying a transaction screen during transaction and a touch panel for selecting a class of transaction and entering transaction information, such as security numbers and the amount of current transaction.

FIG. 2 is a side view of the automated teller machine 1, as seen from an arrowed direction A in FIG. 1, i.e. from the direction of the left side surface 2C of the automated teller machine 1, and conceptually shows particularly a part for processing bills BL, among the internal constituents of the automated teller machine 1. As shown in the figure, the automated teller machine 1 contains in its upper part the customer service unit 3, a controller 10, a validator 12 for determining the denominations and validity of bills BL and a temporary storage 15 for temporarily holding deposited bills BL, as well as in its lower part a bill storage 15 for storing bills BL denomination by denomination.

The automated teller machine 1 contains a conveyer mechanism 11, which conveys bills BL between the constituents over conveying channels 18 denoted with a bold line in FIG. 2. The conveyer mechanism 11 in the embodiment conveys bills BL with the shorter side BL1, FIG. 3, thereof being in parallel with the travelling direction.

The controller 10 is a functional section for generally controlling the entire automated teller machine 1. In particular, for example, when the customer operates the display and operation unit 8 to start deposit transaction, the controller 10 opens the shutter of the bill deposit/withdrawal section 5 to allow bills BL to be inserted into the deposit/withdrawal section, causes the conveyer mechanism 11 to convey the bills BL inserted into the deposit/withdrawal section 5 to the validator 12 for discrimination, and then to convey the bills BL discriminated as being normal bills in the validator to the temporary storage 13 for temporary storage. Further, the controller 10 causes the conveyer mechanism 11 to convey the bills BL discriminated as being invalid in the validator 10 to the bill deposit/withdrawal section 5 to return them to that customer. In turn, when the customer confirms the deposited amount on the display and operation unit 8, the controller 10 allows again the conveyer mechanism 11 to convey the bills BL held in the temporary storage 13 to the validator 12 for discriminating again the denominations and further convey them to the bill storage 15.

The bill storage 15 is a storage mechanism for storing therein the bills BL classified in accordance with denominations, and includes a plurality of bill boxes 16 corresponding to the respective denominations. The bill boxes 16 store, in piles in the thickness direction, bills BL of denominations determined as undamaged by the validator 12 correspondingly to the denominations of the bill boxes 16. Further, the bill storage 15 includes a reject box 17, which stores bills BL discriminated as damaged by the validator 12 in piles in the thickness direction.

Figure 3:
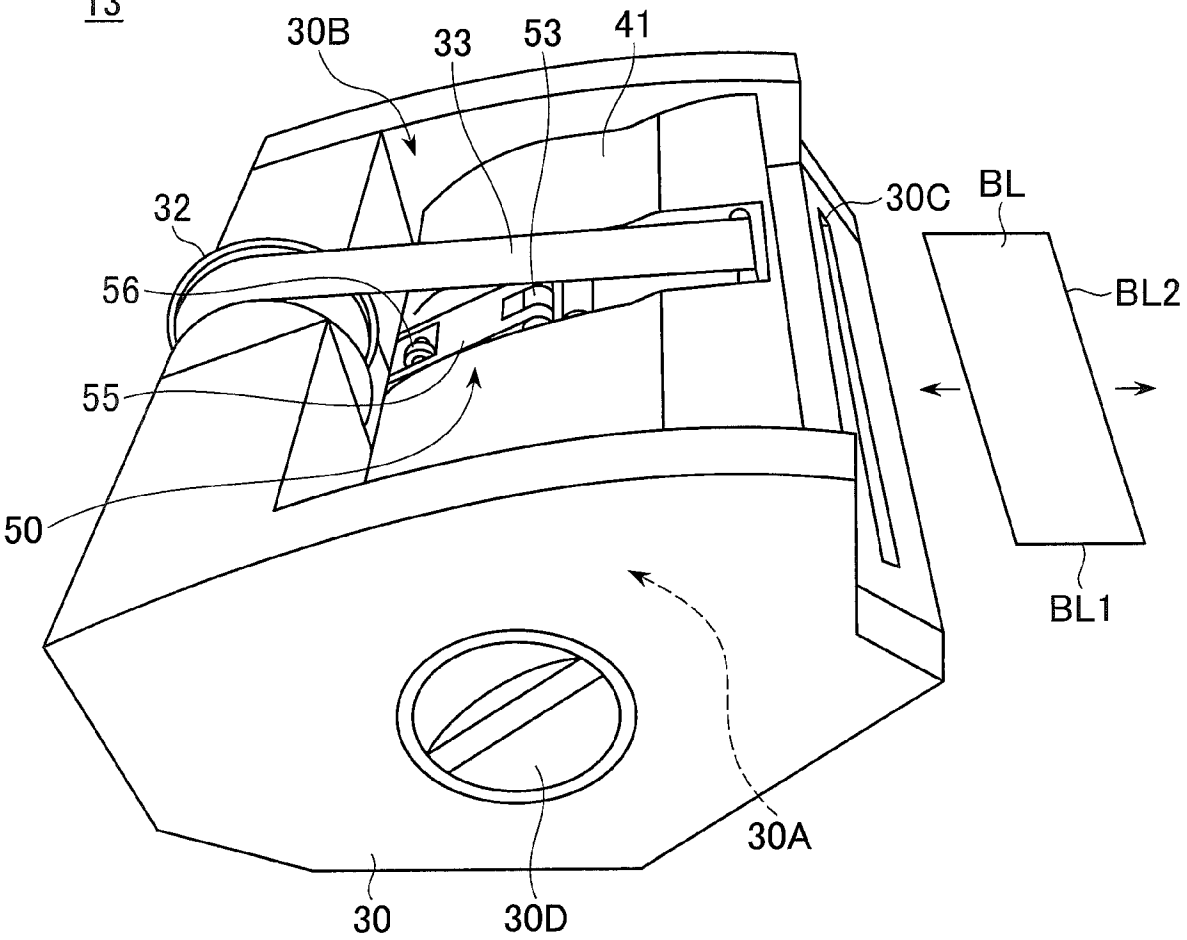
FIG. 3 is a perspective appearance view of a temporary storage in accordance with the present invention, as seen from above on the left side of the machine.

The temporary storage 13 is a storage unit, which temporarily holds bills fed from the deposit/withdrawal section 5 round a drum 31, FIG. 3, so as to be wound thereon. As shown in FIG. 3, it includes a drum 31, an upper reel 32, an upper tape 33, an upper roller 34, a tape sensor 35, a lower reel 36, a lower tape 37, a lower roller 38, a movable unit 40 and a pressing unit 50, which are housed in a frame 30.

Describing the outline, the upper tape 33 unreeled from the upper reel 32, after running toward the right hand in the figure, turns around at the upper roller 34, and then runs toward the left hand. Unreeled from the lower reel 36 is a lower tape 37, which is turned around by a roller 47 and runs toward the left hand. Then, the temporary storage 13 conveys bills BL conveyed from the right hand in the direction of the shorter side BL1 while holding them between the upper tape 33 and the lower tape 37 and winds them round the outer circumferential surface of the drum 31 in an orderly manner while pressing them with a winding roller 53. In this way, the temporary storage 13 winds the bills BL round the outer circumferential surface of the drum 13 in an orderly manner, thereby making it possible to store a number of bills BL within the frame 30.

In the temporary storage 13, the winding roller 53 is pressed against the outer circumference of the drum 31. At the same time, the upper reel 33 and the lower reel 37 are applied with force thereon in the respective winding directions to be in a state of being appropriately tensioned and wind the bills BL round the drum 31 in a fashion curving them along the outer circumference of the drum. At this instant, the drum 31 gradually increases its apparent external diameter since the bills BL are wound round it. Consequently, the winding roller 53 moves via a movable mechanism, described later, to thereby remain in contact with the apparent outermost circumference of the drum 31 as well as to always follow the outermost circumferential surface.

Further, the temporary storage 13 is so constructed that the drum 31 rotates in the direction R2 opposite to that at the time of storing, while taking up the upper tape 33 and the lower tape 37 onto the upper reel 32 and the lower reel 36, respectively, to thereby transfer the bills BL wound round the drum 31 to the conveying channel 44 in order to discharge them outside. Those actions are controlled with the controller 10.

The temporary storage 13 of the embodiment will be described in more detail with reference to FIG. 3. The frame 30 is constituted of bulkheads covering the most part of the outer circumference of the temporary storage 13, such as a front side which will be the front face 2A and a rear side which will be the rear face 2B, respectively, when the temporary storage 13 is installed in the automated teller machine 1, and on the left side which will be the left face 2C and the right side which will be the right face 2D as well as the downside which will be the lower face 2F, respectively, as seen from the customer standing face to face with the side of the front face 2A, and forms an internal space 30A inside the bulkheads. The frame 30 of the embodiment has the topside of its outer circumference opened which will be the top face 2E, and allows access to the internal space 30A from outside through that opening 30B.

The frame 30 comprises a bill deposit/withdrawal slot 30C on the front side thereof and the bill deposit/withdrawal slot 30C is an entrance to the internal space 30A for bills BL. Inside the bulkheads on the left and right sides of the frame 30 there is incorporated a transmission mechanism, such as a gear for transmitting driving power from a motor, not shown, to mechanism members, such as a drum or a roller. Provided on the left side surface of the frame 30 there is a knob 30D for manually rotating a rotary body, such as the drum 31 and a roller, in maintenance work.

Figure 4:
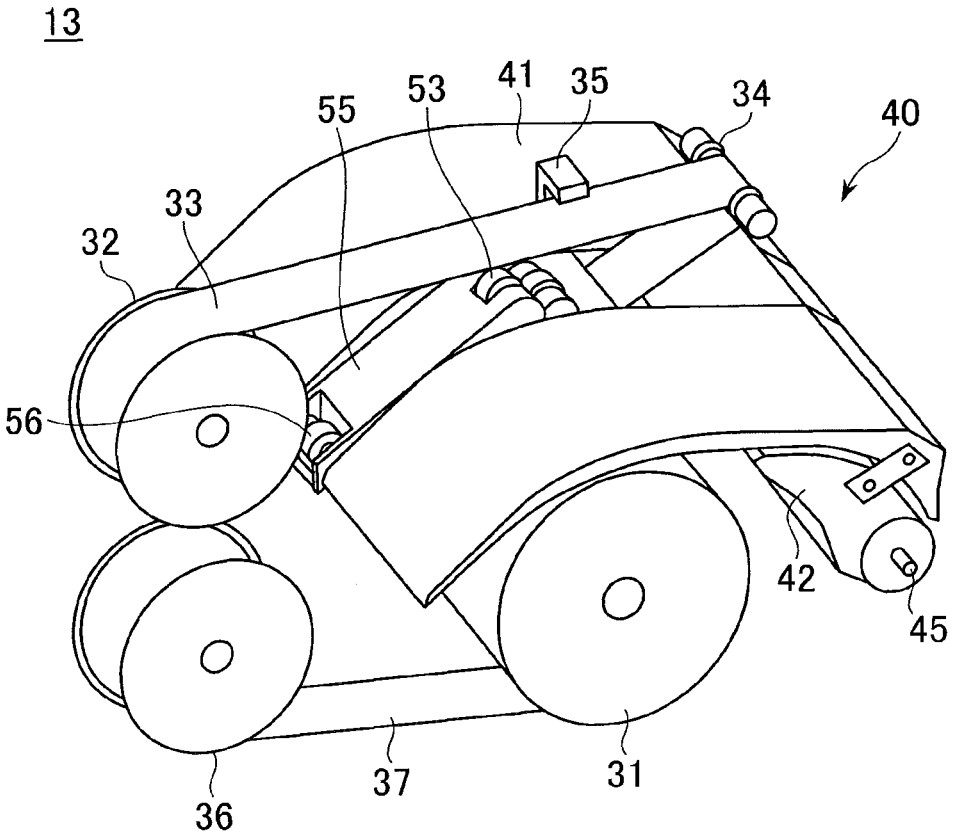
FIG. 4 is a perspective view of the internal structure of the temporary storage of FIG. 3, as seen from above on its rear left side.
Figure 5:
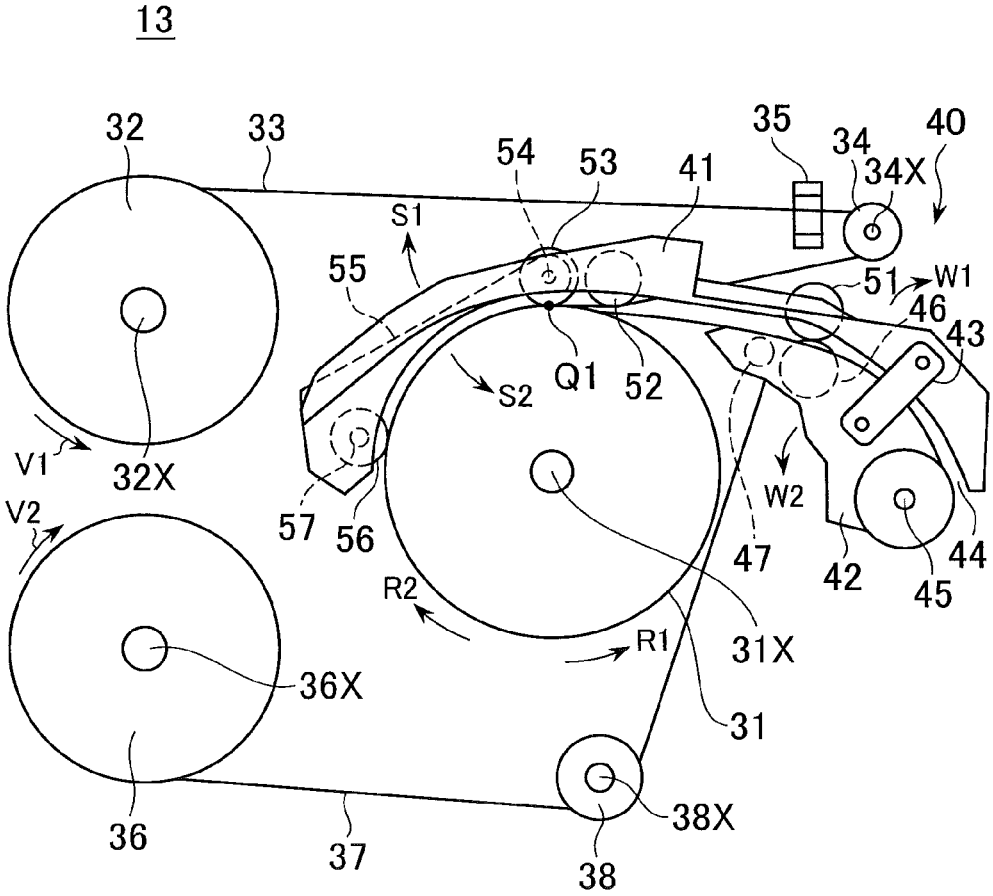
FIG. 5 is a conceptual side view, showing the internal structure of the temporary storage of FIG. 3, as seen from its left side.

FIGS. 4 and 5 show the internal constitution of the temporary storage 13 with the frame 30 removed. FIG. 4 is an external view of the internal part of the frame 30 in the temporary storage 13 as seen obliquely from the upward back. FIG. 5 is a schematic view showing the structure of the temporary storage 13 in the case when the internal part of the frame 30 of the temporary storage 13 is seen from the left.

The drum 31 is a bill holding mechanism for winding bills BL conveyed to the temporary storage 13 round it to hold them. The drum 31 in the embodiment is generally cylindrical and supported on a stationary part, for example, the frame 30 of the apparatus so as to be movable in the winding direction R1 or in the rewinding direction R2 about a rotary shaft 31X parallel to the frame 30 in the left/right direction.

The upper reel 32, formed like a bobbin, is arranged backward and obliquely upward on the drum 31 approximately in the middle in the left/right direction of the temporary storage 13 to be rotatable about a rotary shaft 31X parallel to the rotary shaft 31X of the drum 31.

The upper tape 33 is wound round the upper reel 32. The upper tape 33 in the embodiment is a flexible elongate body formed of thin film resin and having its length sufficient in the longitudinal direction of the tape. The tape width is sufficiently shorter than the longer side BL2 of the bill BL. Further, the upper tape 33 is generally almost transparent, whereas it has its portion non-transparent against light in the dead end area which comes out when the upper tape 33 is wound round the upper reel 32 up to the vicinity of the dead end.

The upper roller 34 is installed on the side ahead of the drum 31 as seen from the upper reel 32, i.e. on the side of the bill deposit/withdrawal slot 30C. The upper roller in the embodiment is generally cylindrical and installed so as to be freely rotatable about the rotary shaft 34X parallel to the rotary shaft 31X of the drum 31. The upper roller 34 has its length in the direction of the rotary shaft 34X substantially longer than the tape width of the upper tape 33.

The upper tape 33 unreeled from the upper reel 32, after being suspended forward so as to be passed transversely across the opening 30B, is passed around the upper roller 34 and is turned back downward. The tip end is fixed on the circumferential surface of the drum 31.

The upper reel 32 is biased in the winding direction V1, which is the direction of winding the upper tape 33, by means of a tension spring, not shown. The tension of a predetermined intensity is thereby always imposed on the upper tape 33.

The tape sensor 35 is installed between the upper reel 32 and the upper roller 34 and adapted to sense the end area of the upper tape 33 on the side of the drum 31. In the instant embodiment, the tape sensor 35 includes a light emitter for emitting detection light of a predetermined intensity and an optical sensor for sensing the detection light, and is so arranged that the upper tape 33 runs between the light emitter and the optical sensor. When the optical sensor is successful in sensing the detection light from the light emitter, the tape sensor 35 detects that what is running between the light emitter and the optical sensor is a transparent portion of the upper tape 33, whereas when the optical sensor fails to sense the detection light, the tape sensor detects that what is running between the light emitter and the optical sensor is the non-transparent portion of the upper tape 33, i.e. the dead end area.

The lower reel 36, which is formed like a bobbin similar to the upper reel 32, is arranged at a place down below the upper reel 32, i.e. a place near the backside on the downside of the drum 31 and is rotatable about the rotary shaft 36X parallel to the rotary shaft 31X of the drum 31.

Round the lower reel 36, wound is a lower tape 37. In the embodiment, the winding direction of the lower tape 37 in the lower reel 36 is the direction V2 opposite to the winding direction of the upper tape 33 in the upper reel 32.

The lower roller 38 is installed in front of the lower reel 36, i.e, on the front side in the winding direction and is rotatable about the rotary shaft 38X parallel to the rotary shaft 31X of the drum 31. The lower roller 38 in the embodiment is formed to be cylindrical, similarly to the upper roller 34 and arranged at a place near the center in the left/right direction of the temporary storage 13. The rotary shaft 38X thereof has its length substantially longer than the tape width of the lower tape 37.

The lower tape 37, after being passed forward from the lower reel 36, runs round the lower roller 38, goes upward, passes through the movable unit 40 and is fixed with its tip end on the circumferential surface of the drum 31. The lower tape 37 is so fixed on the circumferential surface that the upper tape 33 overlaps the surface of the lower tape 37 on the outer circumferential side. The lower tape 37 in the embodiment overlaps the upper tape 33 in the vicinity of the peak in the circumferential surface of the drum 31. Further, in the embodiment, the lower tape 37 is constituted in a way similar to the upper tape 33.

With the arrangement as described above, when the temporary storage 13 rotates the drum 31 in the winding direction R1, it can take up the lower tape 37 and the upper tape 33 in a manner overlapping each other. At this instance, as far as the temporary storage 13 holds the bills BL between the lower tape 37 and the upper tape 33, the bills BL can be wound round the circumferential surface of the drum 31 together with the lower tape 37 and the upper tape 33.

The movable unit 40 includes a movable guide 41, a medium guide 42 and a connection 43. The movable guide 41 is installed above the medium guide 42 and is connected to the medium guide 42 with the connection 43. Between the movable guide 41 and the medium guide 42 there is a clearance sufficiently longer than the thickness of the bill BL, and the clearance forms a conveying channel 44.

The medium guide 42 is shaped into a drop-like or wedge-like form as seen from the left and right sides and has on the front side thereof a pivotal shaft 45 running in the left/right direction. By contrast, the left and right internal surfaces in the frame 30 of the temporary storage 13 are provided above the front side with pivotal holes corresponding to the pivotal shaft 45. When the medium guide 42 is mounted in such a way that the rotary shaft 45 is inserted through the pivotal holes of the frame 30, it can turn about the pivotal shaft 45 in the opening direction W1 or the closing direction W2 with respect to the frame 30.

On the slope surface extending from the front side of the medium guide 42 to the upper side there is provided a cylindrical conveying roller 46 with the front and upper sides thereof not exposed. The conveying roller 46 is rotatably supported on the rotary shaft extending in the left/right direction and can rotate in either direction together with the rotary shaft by means of driving power transmitted through driving mechanism, not shown, to the rotary shaft.

In the back of the conveying roller 46 there is provided a roller 47, which is cylindrical and freely rotatable with a rotary shaft, not shown, inserted therein and extending in the left/right direction of the temporary storage 13. The lower tape 37 passing by the lower roller 38 and running in the upward direction of the temporary storage 13 passes round the roller 47, turns in the backward direction of the temporary storage 13, and goes over the conveying channel 44, i.e. along the bottom face of the movable guide 41 to then reach the drum 31.

Figure 6:
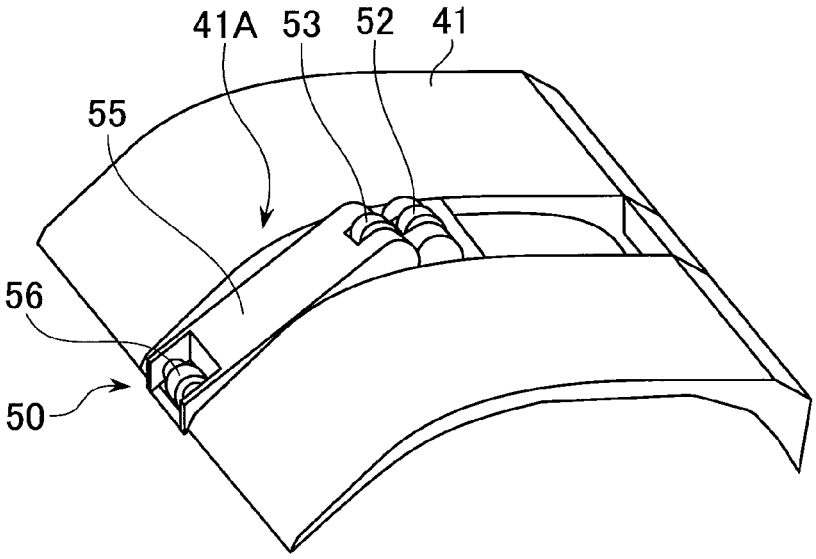
FIG. 6 is a perspective view, showing a movable guide of the temporary storage of FIG. 3, as seen from above on its rear left side.

The movable guide 41, as shown in FIG. 6, is formed generally like a curved plate, and is arranged such that it covers the drum 31 from the upper side thereof in the opening 30B formed on the upper side of the frame 30 of the temporary storage 13.

In more particular, the movable guide 41, as shown in FIG. 5, has its bottom face formed almost planer in the central portion covering largely from the front side part of the drum 31 to the rear side part of the medium guide 42. Further, the rear side part of the movable guide 41 is formed in the rear side part covering the rear side of the drum 31 in such a way that as the bottom face thereof proceeds to the rear side, it trails down in a fashion drawing an arc having a curvature radius substantially larger than that of the outer circumference of the drum 31. Moreover, the movable guide 41 is formed in the front side part opposite to the front side part of the medium guide 42 such that as the bottom face thereof proceeds forward, it trails down in a fashion forming the conveying channel 44 along the shape of the upper surface of the medium guide 42.

The front side part of the movable guide 42 has a cylindrical roller 51 provided at a place opposite to a roller 46 of the medium guide 42. The roller 51 is installed such as to be freely rotatable with a rotary shaft, not shown, inserted into it and extending in the left/right direction and that the downside thereof can be exposed from the bottom face of the movable guide 41. The roller 51 is biased downward with a spring, not shown, and is pressed against the roller 46.

In the upper part in the vicinity of the front end of the movable guide 41, i.e. in the upper part of the roller 51, there is the upper roller 34 provided in the middle in the left/right direction of the temporary storage 13. Further, the movable guide 41 is provided with a through hole for conducting the upper tape 33 into the rear side of the roller 51.

In the rear part of the through hole of the movable guide 41 there is provided a roller 52. The roller 52 is cylindrical and installed with its downside exposing from the bottom face of the movable guide 41 to be freely rotatable with a rotary shaft, not shown, inserted into it and extending in the left/right direction of the temporary storage 13. The roller 52 contacts in the bottom side thereof with the upper tape 33 running from the upper roller 34 to the drum 31.

With the arrangement, the movable unit 40 brings bills BL coming into the temporary storage 13 on the conveying channel in contact with the circumferential surface of the drum 31 in a state of holding the bills BL between the upper tape 33 and the lower tape 37 at a winding point Q1 near the top end on the circumferential surface of the drum 31.

In that situation, in the temporary storage 13 the drum 31 rotates in its winding direction R1 and can thus wind the bills BL held between the upper tape 33 and the lower tape 37 round the circumferential surface of the drum 31.

The pressing unit 50 includes a winding roller 53, a shaft 54, an arm 55 and a guide roller 56. The winding roller 53 is installed at a position posterior to the roller 52 in the movable guide 41 and approximately right above the rotary shaft 31X penetrating the drum 31, i.e. at a position where it is brought into contact with the winding point Q1. The winding roller 53 is cylindrical and installed with its downside exposing from the bottom face of the movable guide 41 to be freely rotatable with a shaft 54 inserted into it and extending in the left/right direction of the temporary storage 13.

Since the movable unit 41 is arranged to be rotatable by the own weight about the rotating shaft 45 as a pivotal axis in the closing direction W2, the winding roller 53 contacts with the vicinity of the upper end on the outer circumference of the drum 31, i.e. the winding point Q1.

Figure 7:
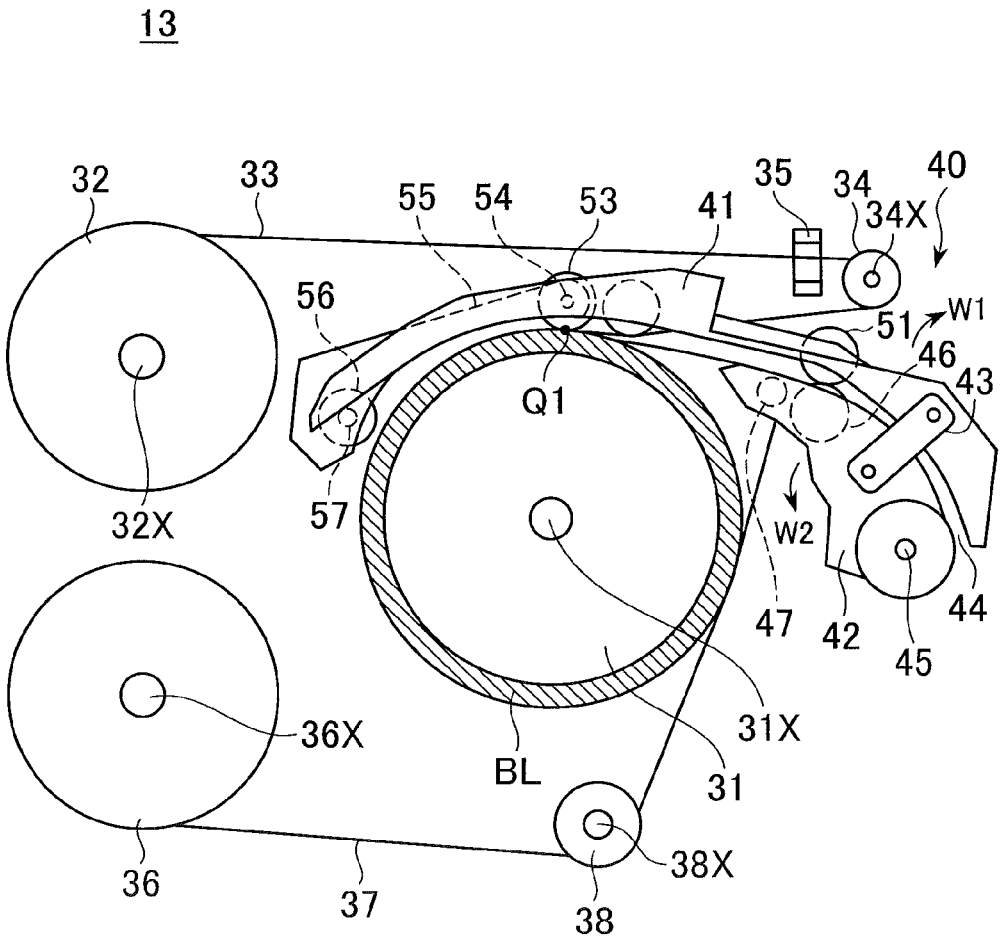
FIG. 7 is a conceptual side view, showing the internal structure of the temporary storage of FIG. 3, as seen from its left side.
Figure 8:
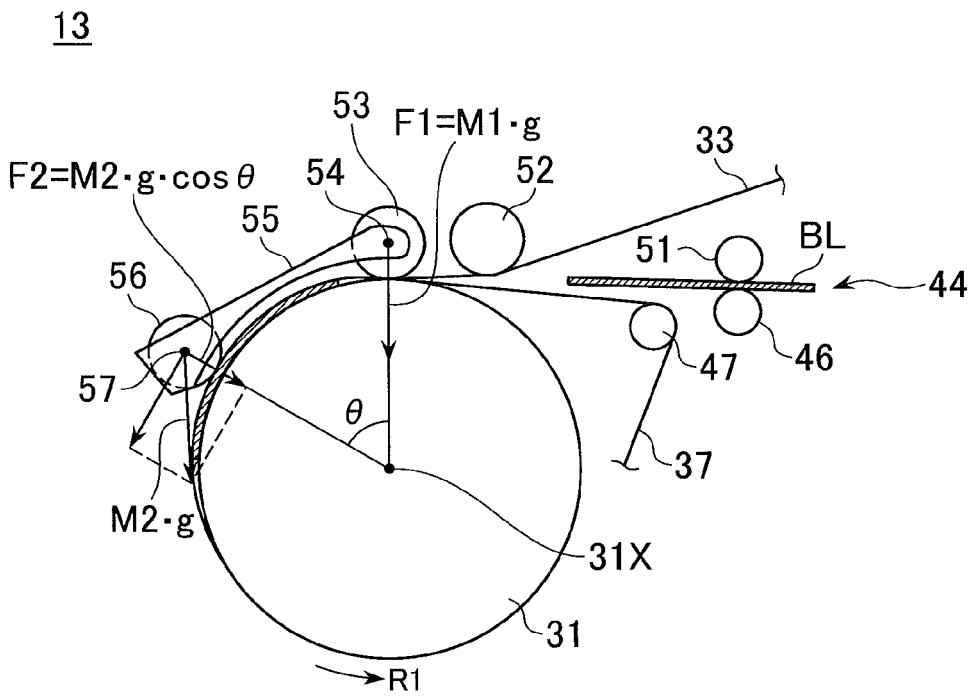
FIG. 8 is an explanatory side view for use in explaining pressing force of a winding roller and a guide roller in the embodiment of FIG. 3.

The drum 31 gradually increases the apparent external diameter as bills BL are wound round it, as shown in FIG. 7. The pivotal unit 40 is lifted up by the winding roller 53, as the whole external diameter of the drum 31 increases, and pivots in the opening direction W1. Consequently, as the whole external diameter of the drum 31 increases, the conveying destination of the conveying channel 44 is kept to the winding point Q1.

The winding roller 53, when the mass of the movable unit 40 is represented by M1 [kg] and gravitational acceleration as being g[m/s$^2$], adds the pressing force F1 expressed in the following expression (1) to the drum, $$F1=M1\cdot g. \quad (1)$$

The movable guide 41 has its portion, backward than the winding roller 53, formed into a notch 41A which is elongate in the front/rear direction, and an arm 55 is provided so as to occlude the notch 41A.

The arm 55, which is generally formed into an elongate rectangular body, has a shaft 54 inserted into it and is freely rotatable about the shaft 54 in the upward direction S1 or the downward direction S2. The arm 55 has its bottom face curved so as to follow the circumferential surface of the drum 31.

In the vicinity of the rear end of the arm 55 there is provided a guide roller 56. The guide roller 56 is cylindrical and arranged with its side facing the drum 31 exposing from the face of the arm 55 facing the drum 31 to be freely rotatable with a shaft 57 inserted into it and extending in the left/right direction of the temporary storage 13.

In the rear part on the upper side of the circumferential surface of the drum 31, the guide roller 56 is, due to the arm 55 being capable of turning in the downward direction S2 by its own weight, pressed forward in the downward direction against the circumferential surface of the drum 31 by the pressing force based on the own weight of the arm 55.

At this instance, when the pressing force of the guide roller 56 against the drum 31 is denoted as F2, F2 is a component directing to the center of the drum 31 of the own weight of the arm 55. In particular, when the mass of the arm 55 imposed on the guide roller 56 via the rotary shaft is represented by M2 [kg] and the angle formed between a line passing the rotary shaft 31X of the drum 31 and the shaft 54 and a line passing the rotary shaft 31X and the shaft 57 is denoted as 6, the guide roller 56 adds the pressing force F2 expressed in the following expression (2) to the drum toward the center thereof, i.e. toward the rotary shaft 31X, $$F2=M2\cdot g\cdot\cos\theta. \quad (2)$$

With the instant embodiment, θ is 60 degrees.

With the arrangement, the movable unit 40, at the winding point Q1, can press the lower tape 37 right after wound round the drum 31, the bills BL and the upper tape 33 toward the center of the drum 31, i.e. toward the rotary shaft 31X, by means of the winding roller 53 and the guide roller 56.

Figure 9:
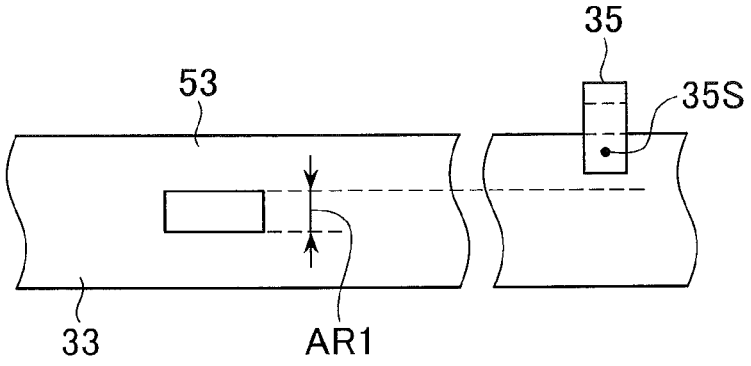
FIG. 9 is a view, showing positional relationship between the winding roller and a tape sensor in the temporary storage of FIG. 3.

The winding roller 53 and the guide roller 56 in the embodiment, as shown in a plan view of FIG. 9, are substantially shorter in width in the left/right direction, i.e. in the direction perpendicular to the running direction of the tape 33, than the upper tape 33, and are brought into contact only with a contact area AR1 which resides approximately in the center of the upper tape 33 in the left/right direction. Then, a tape sensor 35 is arranged such that an irradiation spot 35S of a detection light of the tape sensor 35 is located in an area except the contact area AR1. Thus, the temporary storage 13 of the embodiment can avoid erroneous detection of the tip end portion and dead end portion of the upper tape 33 by the tape sensor 35 even when the contact area AR1 of the upper tape 33 is soiled due to contact with the winding roller 53 and the guide roller 56. Consequently, the temporary storage 13 can assuredly perform winding operation of the bills BL to be wound round and discharging operation of the bills BL to be discharged.

Now, operation of winding the bills BL round the drum 31 in the temporary storage 13 in accordance with the embodiment will be described with reference to FIGS. 10 and 11. In this context, the bills BL are ones hardly curved in the running direction, i.e. in the direction of the shorter side BL1, even when they have been creased or have got into the habit of being folded, i.e. they are so-called "firm" bills. Other bills BLJ are ones wound round the drum 31 immediately before the bills BL.

In that situation, the upper tape 33 and the lower tape 37 have appropriate tension imposed thereon by the upper reel 32 and the lower reel 36, as described above, and the bills BLJ running ahead of the bills BL have been wound round the drum 31.

When the drum 31 rotates in the arrowed direction R1, the bills BL held between the upper tape 33 and the lower tape 37 proceed over the conveying channel 44 on to the winding point Q1.

When the bills BL have not yet reached the winding point Q1, both winding roller 53 and guide roller 56 have been pressed against the circumferential surface of the drum 31, i.e. the peripheral side of the outside tape 33 wound round the outermost.

When the drum 31 rotates further in the winding direction R1, the upper tape 33 and the lower tape 37 are wound round the outer circumferential surface of the drum 31 and both upper tape 33 and lower tape 37 proceed together with the bills BL in the winding direction R1.

Figure 10:
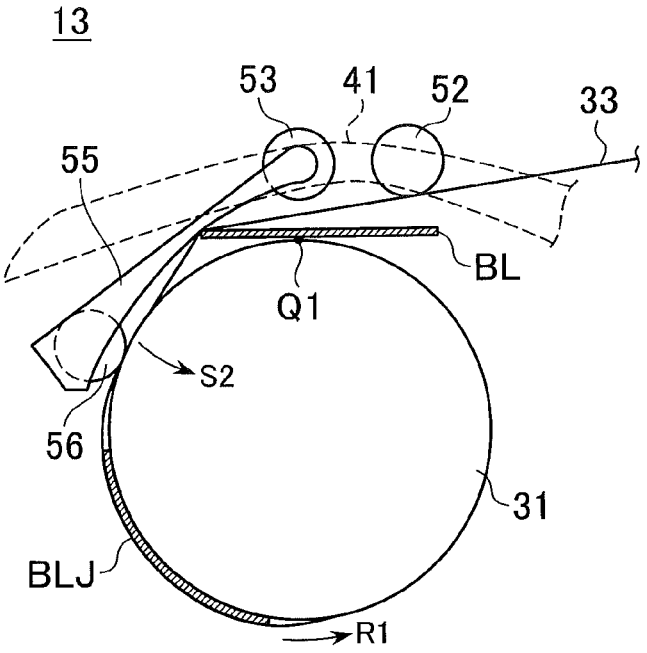
FIGS. 10 and 11 are views, like FIG. 8, for use in explaining operation to wind bills round a drum in the temporary storage of FIG. 3.

As shown in FIG. 10, when the tip end portion of the bill BL has passed by the winding point Q1, but the rear end portion has not yet reached the winding point Q1 and a part of the bill BL is located between the winding roller 53 and the drum 31, then, the bill BL does not run along the circumferential surface of the drum 31 but gets into a state of floating at the tip end thereof.

At this instance, since the bill BL is pressed at the tip end thereof in the downward direction lower than the upper tape 33 but is not curved to an extent that it goes along the circumferential surface of the drum 31, it gets into a state of being floated by the rear end thereof at the winding point Q1 as a supporting point. Thus, the upper tape 33 does not run along the circumferential surface of the drum 31 in the vicinity of the winding point Q1 but presses up the roller 52. The movable guide 41 of the movable unit 40 is lifted up and rotates in the opening direction W1. Resultantly, the winding roller 53 gets into a state of floating from the bill BL.

Meanwhile, the arm 55 turns about the shaft 54 provided in the movable guide 41 as a turning axis by its own weight in the direction S2 of the drum 31 and brings the guide roller in contact with the outside tape 33 wound round the circumferential surface of the drum 31. The guide roller 56 thereby presses the outside tape 33 against the circumferential surface of the drum 31 and the upper tape 33 can remain in a state of pressing the bill BLJ against the drum 31.

Figure 11:
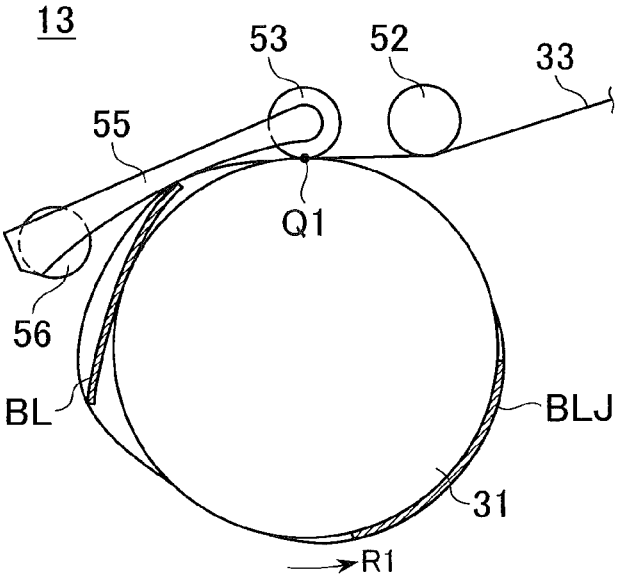

When the drum 31 rotates further in the winding direction R1, the bill BL proceeds toward the guide roller 56, as shown in FIG. 11. At this instance, the outside tape 33 tries to push the bill BL against the circumferential surface of the drum 31 by its tension, whereas the bill BL, since it does not curve along the circumferential surface of the drum 31, tries to lift up the outside tape 33 with both tip end portion and rear end portion thereof in a fashion separating it from the circumferential surface of the drum 31.

Now, the movable unit 40 tends to rotate in the direction S2 of the drum 31 by its own weight. Consequently, on the bill BL in the vicinity of the rear end portion a pressing force in the direction coming close to the circumferential surface of the drum 31 from the lower surfaces of the movable guide 41 and arm 55 acts whereas on the tip end portion only the tension of the outside tape 33 acts.

As a result, the bill BL is pressed at its rear end portion together with the upper tape 33 against the circumferential surface of the drum 31 from the lower surfaces of the movable guide 41 and arm 55, and the tip end portion together with the upper tape 33 gets into a state of being separated from the circumferential surface of the drum 31.

At this instance, the bill BL and the upper tape 33 are pressed against the circumferential surface of the drum 31 by the lower surfaces of the movable guide 41 and arm 55. Further, at the winding point Q1, the winding roller 53 presses the upper tape 33 against the drum 31. Consequently, bills following the bill BL are wound round the drum 31 at the winding point Q1 without forming a clearance between the upper tape 33 and the circumferential surface of the drum 31.

In this way, the temporary storage 13 can wind succeeding bills round the drum without shifting or skewing the bills BL and the bills BLJ.

Well, description will be made on the operation of the temporary storage 13 at the time of discharging the bills BL wound round the drum 31 out of the temporary storage 13. The upper reel 32 and the lower reel 36 rotate in the arrowed directions V1 and V2, respectively, to take up the upper tape 33 and the lower tape 37, respectively. At this instance, the drum 31 rotates in the winding direction R2. Thus, the bills BL wound round the drum 31 pass through the conveying channel 44 via the winding point Q1 and discharged out of the temporary storage 13.

Also in the case of operation for discharging the bills BL, like the case of winding the bills BL, since the upper tape 33 is pressed against the circumferential surface of the drum 31 by at least one of the winding roller 53 and the guide roller 56, it can keep pressing the bills BL against the circumferential surface of the drum 31 by the upper tape 33.

In this way, the temporary storage 13 in the instant embodiment can press the upper tape 33 against the circumferential surface of the drum 31 by the guide roller 56 although the upper tape 33 and the movable unit 40 are lifted up by a firm bill BL when the firm bill BL is wound round the drum 31.

In that way, the temporary storage 13 can maintain the bill BL pressed against the drum 31 by the upper tape 33. Consequently, it is possible to prevent the bill BLJ immediately before the bill BL from shifting or skewing, and it is possible to wind the bills round the circumferential surface of the drum 31 in an orderly manner.

In a conventional temporary storage, a firm bill sometimes lifts up the upper tape from the circumferential surface of the drum, and as a result there would have caused a possibility of loosening in the upper tape. In such a case, conventional temporary storages caused a possibility that a clearance occurs between a bill wound round the drum and the upper tape and the bill wound round immediately before is raised to be shifted or skewed as the drum rotates, or a part thereof is folded. This has resulted in a possibility of causing bills to contact with the internal surface of the frame, or lap over the outside of the upper tape. That may have caused a jam and breakage of bills.

An alternative embodiment of a temporary storage in accordance with the present invention will be described with reference to FIGS. 12 to 16. Throughout the present application, like components are denoted with the same reference numerals.

A temporary storage 113 of the alternative embodiment includes a tape sensor 135 and a movable unit 140, and the movable unit 140 includes a roller pressing unit 150.

Figure 13:
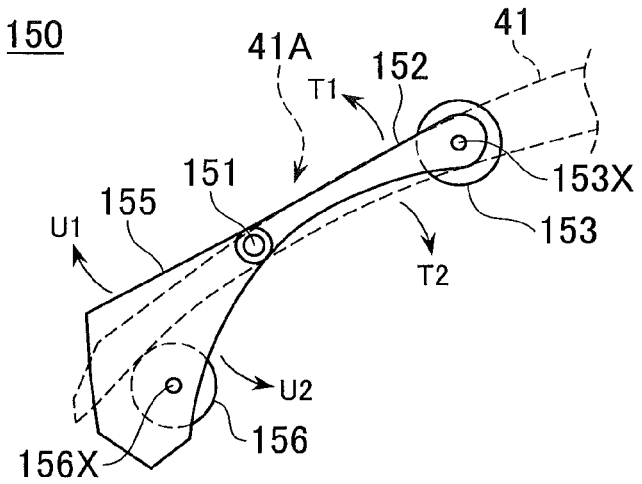
FIGS. 13 and 14 are views, each showing the structure of an arm of the temporary storage of FIG. 12

The roller pressing unit 150 has a shaft 151, as shown in FIG. 13, extending in the left/right direction provided at a place approximately in the middle in an anteroposterior direction in the notch 41A. The shaft 151 is provided with arms 152 and 155 extending forward and backward, respectively, so as to occlude the notch 41A.

Figure 14:
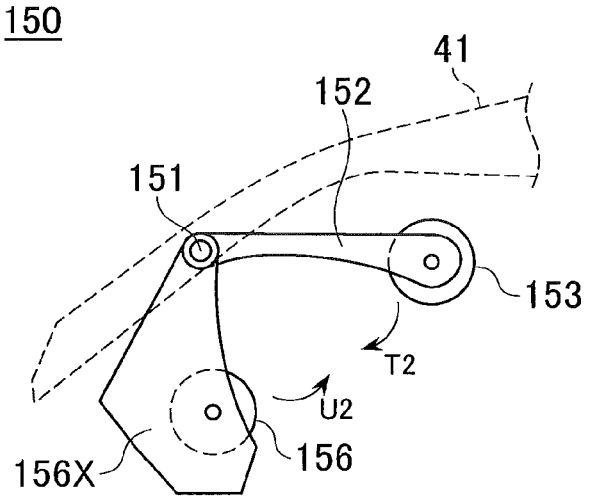

One of the arms, i.e. the winding arm 152, has a shaft 151 inserted therein at the rear end thereof and can freely rotate about the shaft 151 in the upward direction T1 and the downward direction T2. Further, the arm 152 is biased with a torsion spring, not shown, in the downward direction T2, as shown in FIG. 14. In the vicinity of the winding arm 152 there is arranged a winding roller 153 rotatable about a shaft 153X, and the winding roller 153 installed with the lower side thereof exposing from the lower side of the arm 152.

With the arrangement, since the movable unit 140 pivots in the closing direction W2 by the own weight thereof and the arm 152 is biased in the downward direction T2 by the torsion spring, the arm 152 can bring the winding roller 153 in contact with the circumferential surface of the drum 31. At this instance, the winding roller 153 is pressed against the winding point Q1.

The other arm 155 has the shaft 151 inserted therein at the front end part and is rotatable about the shaft 151 in the upward direction U1 or the downward direction U2. Further, it is biased in the arrowed direction U2 in FIG. 14 by the torsion spring.

In the vicinity of the rear end of the arm 155, there is mounted a guide roller 156 corresponding to the guide roller 56, and the guide roller 156 has the lower side exposed from the lower surface thereof so as to be rotatable about a shaft 156X.

With the arrangement, since the arm 155 pivots, like the arm 152, in the closing direction W2 by the own weight of the movable unit 140 and is biased in the arrowed direction U2 by the torsion spring, it can bring the guide roller 156 in contact with the circumferential surface of the drum 31. At this instance, the guide roller 156 is pressed against the upper side in the rear of the circumferential surface of the drum 31. In this case, the pressing force caused by the winding roller 153 has been adjusted to be substantially stronger than the pressing force caused by the guide roller 156.

Figure 15:
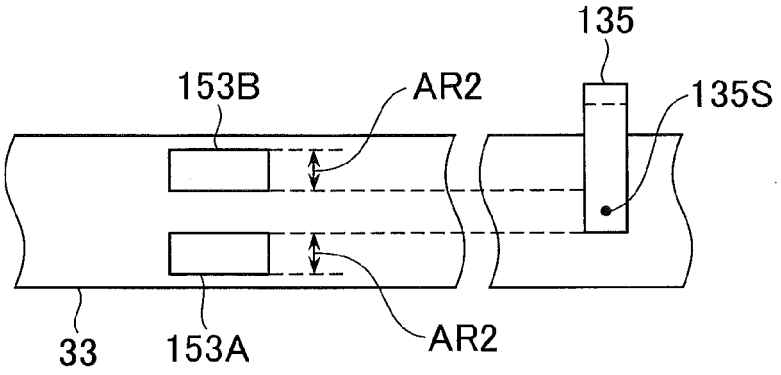
FIG. 15 is a view, like FIG. 9, showing positional relationship between the winding roller and the tape sensor in the temporary storage of FIG. 12.

The winding roller 153 of the alternative embodiment comprises two winding rollers 153A and 153B placed in parallel to each other at a predetermined distance on the right and left sides, as shown in FIG. 15, and the winding rollers 153A and 153B are brought in contact with the upper tape 33 in a contact area AR2.

Further, the guide roller 156 comprises, like the winding roller 153, two winding rollers, not shown, placed in parallel with each other at a predetermined distance on the right and left sides. The winding roller 156 is, like the winding roller 153, arranged to be brought in contact with the upper tape 33 in the contact area AR2, as shown in FIG. 15.

By contrast, the tape sensor 135 is arranged to irradiate detection light to an irradiation spot 135S deviating from the contact area AR2 in the upper tape 33. Therefore, in the temporary storage 113, even if the upper tape 33 is tainted due to contact with the winding roller 153 or the guide roller 156, no taint damage occurs in places except for the contact area AR2, and thus the detection light cannot be intercepted by such taint damage, thereby making it possible to avoid erroneous detection of the tip end portion.

Figure 16:
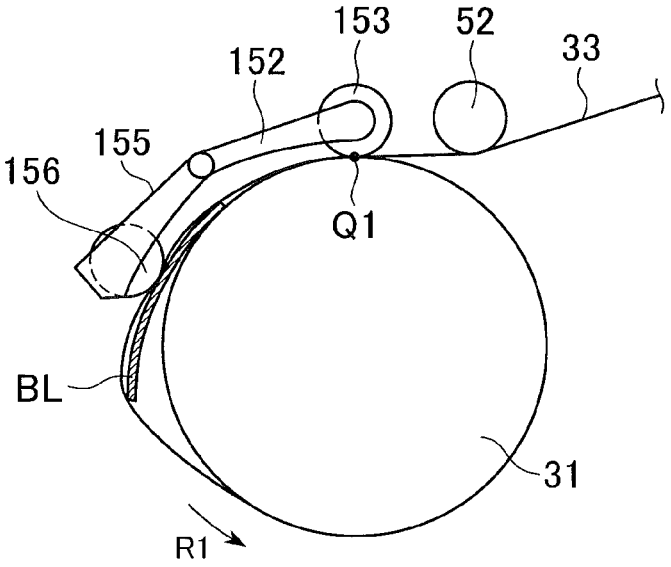
FIG. 16 is a view, like FIG. 10, for use in explaining operation to wind bills round the drum in the temporary storage of FIG. 12.

Operation of the temporary storage 113 of the alternative embodiment will be described with reference to FIG. 16. In the temporary storage 113 of the embodiment, like the first embodiment, an appropriate tension is applied on the upper tape 33 and the lower tape 37 by the upper reel 32 and the lower reel 36, respectively.

The drum 31 rotates in the arrowed direction R1 and the bill BL proceeds from the conveying channel 44 to the winding point Q1. Further, in the temporary storage 113, the winding roller 153 is pressed against the circumferential surface at the winding point Q1 on the drum 31 by means of pressing force caused by the own weight of the movable unit 140 and the arm 152, and also the guide roller 156 is pressed against the circumferential surface on the upper side in the rear of the drum 31 by means of pressing force caused by the movable unit 140 and the arm 155.

With the temporary storage 113 of the embodiment, as the guide roller 156 presses the upper tape 33 against the drum 31, the adjacent bill BLJ already wound round the circumferential surface of the drum 31 can be kept in a state of being pressed against the drum 31 by the upper tape 33. For the following bill BL, as shown in FIG. 16, although the upper tape 33 is raised by the tip end portion of the bill BL, the rear end portion of of the bill BL and its vicinity can be pressed against the circumferential surface of the drum 31 by the guide roller 156.

Further, with the temporary storage 113, as the winding roller 153 presses the upper tape 33 against the drum 31 at the winding point Q1 after the bill BL has passed by the winding point Q1, bills following the bill BL can start to be wound without having clearance between the upper tape 33 and the circumferential surface of the drum 31 at the winding point Q1.

In this way, with the temporary storage 113 of the alternative embodiment, as the winding roller 153 is installed in the movable unit 140 via the pivotal arm 152, it is possible to press the winding roller 153 alone against the drum 31, granted that the movable unit 140 could have lifted up by a firm bill. Consequently, in the temporary storage 113 bills BL can be kept wound round the drum 31 without fail.

Figure 17:
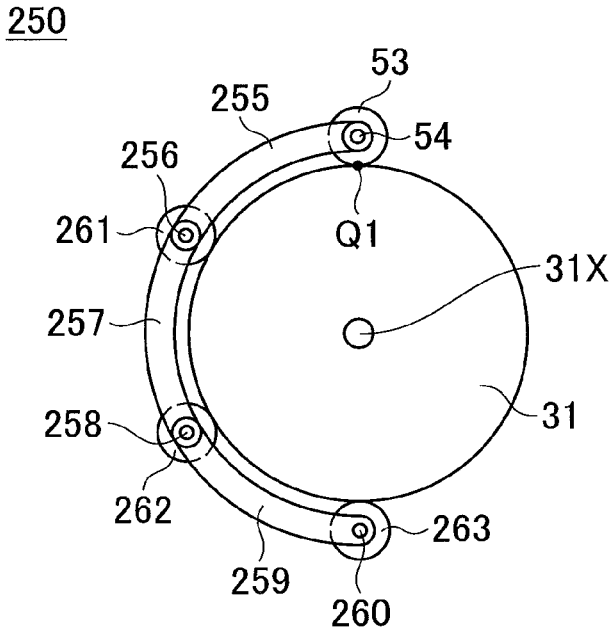
FIG. 17 is a substantial side view, showing the relevant part of a further alternative embodiment of the temporary storage in accordance of the present invention.

With reference to FIG. 17, description will be made on a further alternative embodiment of a temporary storage in accordance with the present invention. Of course, like components are denoted with the same reference numerals. The temporary storage of the instant alternative embodiment includes a movable unit 240, which includes a roller pressing unit 250.

In the roller pressing unit 250, there are a plurality of arms 255, 257 and 259 which are pivotably connected in line with each other and have the tip ends thereof carrying rotatable guide rollers 261 to 263.

In more particular, the roller pressing unit 250 has the arm 255 pivotably mounted about a shaft 54 functioning as a rotary axis of the winding roller 53, to which arm 255 there is the arm 257 pivotably mounted via a shaft 256, to the latter arm 257 the arm 259 being pivotably mounted via a shaft 258. The arm 258 has its tip end mounting a shaft 260.

Each of the arms 255, 257 and 259 in the instant embodiment is formed into an elongate quadrangular prism curved so as to follow the peripheral surface of the drum 31 with the longitudinal direction thereof arranged to follow the circumferential direction of the drum 31. Each of the arms 255, 257 and 259 in the embodiment has its length extending across a sector of about 60 degrees as seen from the central axis 31X of the drum 31, but is not to be confined to that.

Moreover, the arm 255 is biased toward the central shaft 31X of the drum 31 with respect to the movable guide 41 by biasing means, such as a spring, not shown, while the arms 257 and 259 are also biased toward the central shaft 31X by biasing means, such as a spring.

Further, the shafts 256, 258 and 260 are provided, respectively, with guide rollers 261, 262 and 263 rotatable about the respective shafts 256, 258 and 260. The guide rollers 261, 262 and 263 are pressed against the circumferential surface of the drum 31 by the respective arms 255, 257 and 259.

The drum 31 changes its apparent external diameter dependent upon the number of bills BL wound round the circumferential surface thereof, in response to which in the pressing unit 250, as the arms thereof are adjacent to each other and pivotable with respect to each other and yet biased toward the central shaft 31X by means of biasing means, not shown, the guide rollers 261, 262 and 263 can be kept in contact with the circumferential surface of the drum 31.

Operation of the temporary storage in accordance with the alternative embodiment will be described. In the temporary storage of the embodiment, appropriate tension is applied on the upper tape 33 and the lower tape 37, respectively, by the upper reel 32 and the lower reel 36. A bills BL is pressed against the circumferential surface at the winding point Q1 on the drum 31 by the winding roller 53 by means of pressing force caused by the own weight of the movable unit 40. Further the bill BL is pressed against the circumferential surface of the drum 31 by the guide rollers 261, 262 and 263 by means of pressing force caused by the biasing means, not shown.

An immediately preceding bill BLJ already wound round the circumferential surface of the drum 31 before remains pressed against the drum 31 since the guide roller 263 and the winding roller 53 press the upper tape 33 against the drum 31. Further, when the bill BL makes advance to the rear side farther than the winding a bill BL point Q1 by the rotation of the drum 31 to even lift up part of the upper tape 33 by the tip end portion of the bill BL, the rear end portion of the bill BL and its vicinity as well as the part of the upper tape 33 are pressed against the circumferential surface of the drum 31 by the guide rollers 261, 262 and 263.

In this way, with the temporary storage of the embodiment, the arms 255, 257 and 259 are joined pivotably to each other so as to cover the half of the rear side on the circumferential surface of the drum 31, and the plurality of guide rollers 261, 262 and 263 are arranged with spaces left therebetween. It it therefore possible to continuously press firm bills BL or the upper tape 33 against the circumferential surface. Consequently, it is possible to effectively prevent deviation, such as shift or skew, of bills BL during rotation of the drum 31, and it is thus possible to wind bills on the circumferential surface of the drum 31 in an orderly manner.

Now, in the embodiment shown in FIG. 5, the shaft 54 may not be fixed to the movable guide 41. For example, the shaft 54 may be mounted movably up and down with respect to the movable guide, and may be biased downward with respect to the movable guide 41 by means of biasing means, such as a spring, so as to allow the winding roller 53 to freely swing up and down with respect to the movable guide 41. In such a case, for example, even if the lower face of the movable guide 41 is lifted up by a bill BL, only the shaft 54 and the winding roller 53 can move downward, and it is therefore possible to bring the winding roller 53 in contact with the winding point Q1 on the drum 31. This also applies to the embodiment shown in FIG. 17.

Further, in the embodiment shown in FIG. 5, the guide roller 56 may not be provided on the arm 55. For example, the shaft 57 of the guide roller 56 may be mounted movably with respect to the movable guide 41, and the shaft 57 may be biased downward with respect to the movable guide 41 by means of a spring or the like so as to make the guide roller 56 freely swing up and down. In such a case, the temporary storage 13 may not include the arm 55.

Still further in the embodiment shown in FIG. 5, the winding roller 53 may not be pressed against the drum 31 by the own weight of the movable unit 40. For example, an biasing member, such as a spring, may be incorporated in the rotary shaft 45 to cause bias power in the closing direction W2, thereby enhancing the force for pressing the winding roller 53 against the drum 31, or to cause biasing power in the opening direction W1 to thereby weaken the force for pressing the winding roller 53 against the drum 31. In such cases, the movable unit 40 is not required to be installed on the upper side of the drum 31, but may be installed, for example, on the front side, the rear side, or other side, such as the lower side. This also applies to the embodiments shown in FIGS. 12 and 17.

Figure 12:
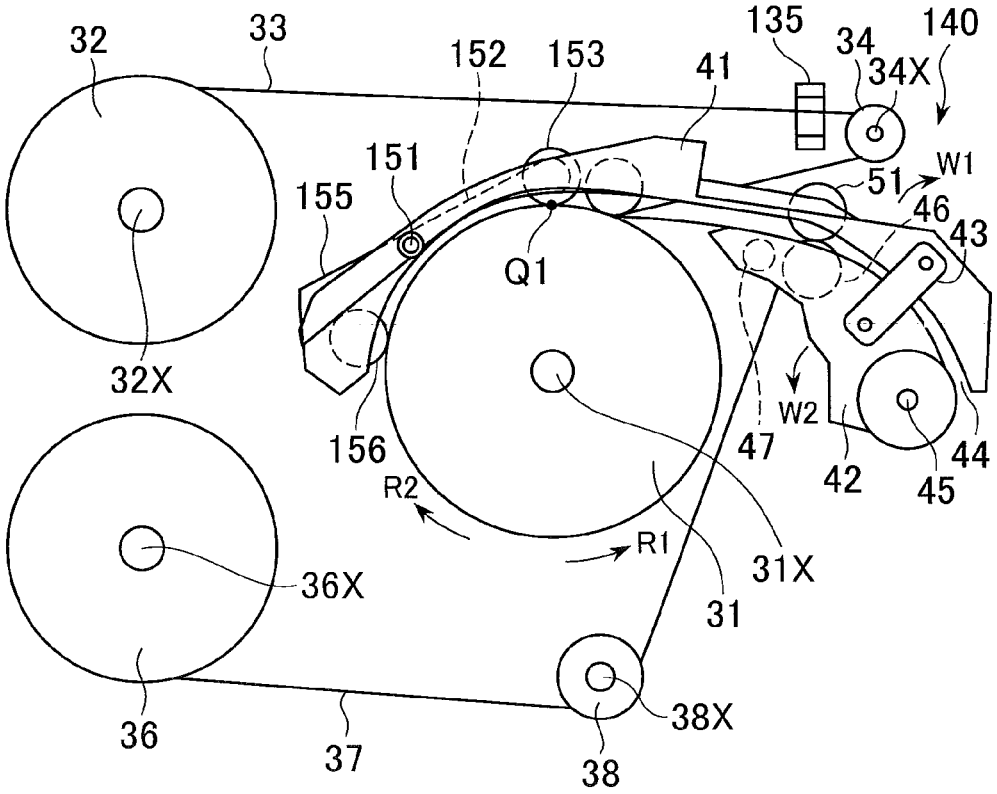
FIG. 12 is a conceptual side view, like FIG. 5, showing the internal structure of an alternative embodiment of the temporary storage in accordance with the present invention, as seen from its left side.

In the embodiment shown in FIG. 5, the arm 55 may be biased, like the case of the arms 152 and 155 in the embodiment shown in FIG. 12, in the downward direction S2 by an biasing member, such as a spring, to increase the force for pressing the guide roller 56 against the circumferential surface of the drum 31. In that case, it is desirable that the pressing force produced by the guide roller 56 do not exceed the pressing force produced by the winding roller 53, thereby bringing the winding roller 53 into as much contact with the winding point Q1 on the drum 1 as possible.

In the embodiment shown in FIG. 12, the arms 152 and 155 may not be energized by a torsion spring, but the arms 152 and 155 may energized in the downward directions T2 and U2, respectively, by biasing means, for example, a leaf spring, a coil spring or other biasing means. Further, in case that sufficient biasing power can be attained by the own weight of the arms 152 and 155, biasing means may not be provided.

In the embodiment shown in FIG. 5, an angle θ formed by the line passing the rotary shaft 31X and shaft 54 and the line passing the rotary shaft 31 and the shaft 57 may not be about 60 degrees as described earlier. The angle θ may be an arbitrary angle, such as about 45 degrees, about 70 degrees and so on. In such cases, since the pressing force F2, as represented by expression (2), is proportional to cos θ, the angle θ is preferably equal to or below 90 degrees, provided that distance between the winding roller 53 and the guide roller 56 is preferably determined in consideration of the length of bills BL in the running direction, i.e. the length of the shorter side BL1 of bills BL in the embodiment shown in FIG. 5. That is also the case with the embodiment shown in FIG. 5.

In the embodiment shown in FIG. 17, the number of arms of the roller pressing part 259 may not be three, but may be arbitrary number larger than one. Correspondingly, the number of guide rollers may not be three, but may be arbitrary number larger than one. Further, the shaft of the guide roller may be used in common to the shaft in the parts joining the arms to each other, or may be mounted at a position on the length of the arms. Moreover, the lengths of those arms may be equal to, or different from, each other.

In the embodiment shown in FIG. 12, the winding roller 153 and the guide roller 156 may include respectively three or more winding rollers arranged in parallel to each other in the left/right direction. The respective rollers may be arranged in any way as far as the irradiation spot 135S of the detection light and the contact area AR2 of the rollers do not overlap each other. Such arrangement applies also to the cases in FIGS. 5 and 17.s In the embodiment shown in FIG. 5, the tape sensor 35 may not be of the type utilizing the transmissivity of light in the upper tape 33 to detect the tip end portion of the upper tape 33. For example, if the upper tape has a reflecting area of higher reflectivity at its tip end portion and the remaining portion being a poor-reflecting area having lower reflectivity, the tape sensor utilizing the reflectivity of the light can detect the tip end portion of the upper tape. Also in this case, the irradiating spot of the detection light on the upper tape may be set avoiding the contact area AR of the rollers. This applies also to the embodiments shown in FIGS. 12 and 17.

In the embodiment shown in FIG. 5, the detection light irradiating spot 35S of the tape sensor may be located in the contact area AR, for example, in the case that taint damage of the upper tape 33 due to contact with the winding roller 53 and the guide roller 56 is not an obstacle to the transmissivity of light detected by the tape sensor 35. This applies also to the embodiments shown in FIGS. 12 and 17.

In the embodiment shown in FIG. 5, the lower surface of the arm 55, i.e. the surface opposite to the drum 31, may not be curved into a circular arc, but may be formed into various shapes, for example, a planar shape, an arbitrarily curved surface shape, or a shape formed of a combination of plural planar surfaces and curved surfaces. In this case, it is preferable to smoothly advance bills BL or the upper tape 33 brought in contact with the drum 31 in consideration of the possibility that the drum 31 rotates with the upper tape 33 lifted up by a firm bill BL or the rear end of this bill BL being brought in contact therewith.

Also in the embodiment shown in FIG. 5, the pivotal axes of the winding roller 53 and the arm 55 may not commonly be implemented by the shaft 54. Instead, for example, the pivotal axes of the winding roller 53 and the arm 55 may be positioned differently from each other.

Further, the aforementioned embodiment shown in FIG. 5, the temporary storage 13 may include two or more pairs of the upper and lower tapes 33 and 37. This applies also to the embodiments shown in FIGS. 12 and 17.

In the embodiment shown in FIG. 5, bills BL may not be held between the upper and lower tapes 33 and 37 provided in the temporary storage 13 to wind the bills BL round the circumferential surface of the drum 31. For example, an adhesive tape may be used for the upper tape 33 to stick bills BL to the upper tape 33 to thereby wind them on the circumferential surface of the drum 31. This applies also to the embodiments shown in FIGS. 12 and 17.

In the embodiment shown in FIG. 5, the temporary storage 13 is applicable not only to the automated teller machine 1 but various kinds of apparatuses. For example, it may be applied to an apparatus for performing only discrimination of sheet-like media, such as bills, or of strip-like media. Further, the temporary storage 13 in accordance with the invention may be applied to various kinds of apparatuses for winding sheet-like media, such as gift coupons, exchange tickets or admission tickets, over the drum 31 for storage. In such cases, parameters for the tape widths of the upper and lower tapes 33 and 37, the length of the arm 55 in the forward/backward direction or the like may be appropriately determined according to the size and form of such media. Those apply also to the embodiments shown in FIGS. 12 and 17.

In the embodiment shown in FIG. 5, the drum 31, movable unit 40, upper tape 33, winding roller 53, guide roller 56 and pressing unit 50 may not be ones specifically described above, but may be ones structured differently. Also, the customer service unit 3 as a reception section, the conveyer mechanism 11 and the movable unit 40 may not be ones specifically described above, but may be ones structured differently.

The entire disclosure of Japanese patent application No. 2011-199627 filed on Sep. 13, 20111, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

The invention claimed is:

1. A medium handling apparatus handling a sheet-like medium to be conveyed, comprising:

a stationary part having pivotal holes;

a drum supported on the stationary part rotatably about a rotary shaft, the drum having a cylindrical circumferential surface;

a movable unit movable with respect to said drum for conveying the medium between a deposit/withdrawal slot for the medium and a vicinity of a winding point where the medium is started to be wound around the circumferential surface, the movable unit including a movable guide arranged such that the movable guide covers a portion of the cylindrical circumferential surface of the drum from an upper side of the drum, a medium guide disposed below the movable guide and disposed relative to the movable guide so that a conveyance channel is formed therebetween for conveying the medium, a pivotal shaft inserted through the medium guide and the pivotal holes of the stationary part, the pivotal shaft supporting the medium guide so that the medium guide is pivotable about the pivotal shaft to rotate in an opening direction and a closing direction, and a connection connecting the medium guide to the movable guide;

a tape, having a tape width substantially shorter than a length of the medium in a width direction of the medium perpendicular to a running direction of the medium, for winding the medium fed from said movable unit around the circumferential surface;

a winding roller supported on said movable guide rotatably about a rotary shaft substantially parallel to the rotary shaft of said drum, the winding roller being separably in contact with said drum for pressing said tape against the circumferential surface at the winding point;

a guide roller supported on said movable unit rotatably about a rotary shaft substantially parallel to the rotary shaft of said drum, the guide roller being separably in contact with said drum for pressing said tape against the circumferential surface at a position where said tape is separated from said winding roller in an outer circumferential direction of said drum, the guide roller being provided downstream of said winding roller in a tape winding direction of said drum; and a pressing unit pressing said guide roller and said winding roller against the circumferential surface, wherein a winding and pressing force caused by said winding roller pressing said tape against the circumferential surface is substantially greater than a guiding and pressing force caused by said guide roller pressing said tape against the circumferential surface, wherein said movable unit includes a pivoting arm pivotally supported on the rotary shaft of said winding roller to be rotatable with respect to a part of the movable unit, said guide roller being supported on said pivoting arm, further wherein the pivoting arm has a surface on a drum side, the surface of the pivoting arm being curved so as to follow the circumferential surface of the drum, and further wherein the winding roller and the pivoting arm are supported by the movable guide.

2. The apparatus in accordance with claim 1, wherein said movable unit has a portion having a notch corresponding to said tape, said pivoting arm being arranged to occlude the notch.

3. The apparatus in accordance with claim 2, wherein said movable unit is installed in an upper part side of said drum and presses said winding roller against said drum by a weight of the movable unit, a winding and pressing force caused by the weight of said movable unit pressing against the winding roller is substantially greater than a guiding and pressing force caused by a weight of said pivoting arm pressing against the guide roller.

4. The apparatus in accordance with claim 2, wherein said pressing unit includes a biasing means for biasing said pivoting arm towards said drum so that the guiding and pressing force is substantially weaker than the winding and pressing force.

5. The apparatus in accordance with claim 1, wherein said movable unit includes a pivotable winding arm and said winding roller is installed on said winding arm;

said pressing unit biases said pivoting arm and said winding arm from said movable unit toward the circumferential surface so that the guiding and pressing force caused by said guide roller is substantially weaker than the winding and pressing force caused by said winding roller.

6. The apparatus in accordance with claim 1, further comprising:

a second arm provided to be pivotable with respect to said pivoting arm or with respect to another arm of the apparatus provided pivotably with respect to said pivoting arm; and a second guide roller provided on said second arm to be rotatable about a rotary shaft substantially parallel to the rotary shaft of said drum, said pressing unit pressing said guide roller, said second guide roller and said winding roller against the circumferential surface so that the winding and pressing force is substantially greater than a second guiding and pressing force caused by said second guide roller pressing said tape against the circumferential surface.

7. The apparatus in accordance with claim 1, further comprising a detector using a property of said tape for detecting a position of said tape in a longitudinal direction, said tape having a detection area, different in a property from another portion of the tape, at a predetermined position of the tape in the longitudinal direction, said winding roller and said guide roller being substantially shorter in a width direction than the tape width of said tape and being brought in contact with said tape in a predetermined contact area in a width direction of said tape, said detector detecting the detection area at a place different from the contact area in the width direction of said tape.

8. The apparatus in accordance with claim 7, wherein said tape has light transmissivity in the detection area substantially lower than light transmissivity in the other portion, said detector including an optical sensor sensing the detection area in response to light not penetrating said tape.

9. A medium transaction apparatus dealing with a sheet-like medium, comprising:

a reception section accepting transaction of the medium;

a conveyer mechanism conveying the medium accepted by said reception section;

a stationary part having pivotal holes;

a drum supported on the stationary part rotatably about a rotary shaft, the drum having a cylindrical circumferential surface;

a movable unit movable with respect to said drum for conveying the medium between a deposit/withdrawal slot of the medium and a vicinity of a winding point at which the medium is started to be wound around the circumferential surface, the movable unit including a movable guide arranged such that the movable guide covers a portion of the cylindrical circumferential surface of the drum from an upper side of the drum, a medium guide disposed below the movable guide and disposed relative to the movable guide so that a conveyance channel is formed therebetween for conveying the medium, a pivotal shaft inserted through the medium guide and the pivotal holes of the stationary part, the pivotal shaft supporting the medium guide so that the medium guide is pivotable about the pivotal shaft to rotate in an opening direction and a closing direction, and a connection connecting the medium guide to the movable guide;

a tape, having a tape width substantially shorter than a length of the medium in a width direction of the medium perpendicular to a running direction of the medium, for winding the medium fed from said movable unit around the circumferential surface;

a winding roller supported on said movable guide rotatably about a rotary shaft substantially parallel to the rotary shaft of said drum, the winding roller being separably in contact with said drum for pressing said tape against the circumferential surface at the winding point;

a guide roller supported on said movable unit rotatably about a rotary shaft substantially parallel to the rotary shaft of said drum, the guide roller being separably in contact with said drum for pressing said tape against the circumferential surface at a position where said tape is separated from said winding roller in an outer circumferential direction of said drum, the guide roller being provided downstream of said winding roller in a tape winding direction of said drum; and a pressing unit pressing said guide roller and said winding roller against the circumferential surface, wherein a winding and pressing force caused by said winding roller pressing said tape against the circumferential surface is substantially greater than a guiding and pressing force caused by said guide roller pressing said tape against the circumferential surface, wherein said movable unit includes a pivoting arm pivotally supported on the rotary shaft of said winding roller so as to be rotatable with respect to a part of the movable unit, said guide roller being supported on said pivoting arm, further wherein the pivoting arm has a surface on a drum side, the surface of the pivoting arm being curved so as to follow the circumferential surface of the drum, and further wherein the winding roller and the pivoting arm are supported by the movable guide.

10. A medium handling apparatus handling a sheet-like medium to be conveyed, comprising:

a tape holding the medium;

a stationary part having pivotal holes;

a drum supported on the stationary part and having an outer circumferential surface to which one end of said tape is fixed for winding said tape around the outer circumferential surface while the drum rotates;

a movable unit supported on the stationary part separably from the outer circumferential surface and extending in a tape winding direction of said drum over a part of the outer circumferential surface so that said tape runs between the outer circumferential surface and said movable unit, the movable unit including a movable guide arranged such that the movable guide covers a portion of the outer circumferential surface of the drum from an upper side of the drum, a medium guide disposed below the movable guide and disposed relative to the movable guide so that a conveyance channel is formed therebetween for conveying the medium, a pivotal shaft inserted through the medium guide and the pivotal holes of the stationary part, the pivotal shaft supporting the medium guide so that the medium guide is pivotable about the pivotal shaft to rotate in an opening direction and a closing direction, and a connection connecting the medium guide to the movable guide;

a winding roller supported on said movable guide separably from the outer circumferential surface for pressing said tape against said drum, the winding roller being separably in contact with said drum for pressing said tape against the outer circumferential surface at a winding point where the medium is started to be wound around the outer circumferential surface; and a guiding roller provided downstream of said winding roller in the tape winding direction for pressing said tape against the outer circumferential surface of said drum, wherein said movable unit includes a pivoting arm pivotally supported on a rotary shaft of said winding roller to be rotatable with respect to a part of the movable unit, said guiding roller being supported on said pivoting arm, further wherein the pivoting arm has a surface on a drum side curved so as to follow the circumferential surface of the drum, and further wherein the winding roller and the pivoting arm are supported by the movable guide.

11. The apparatus in accordance with claim 10, wherein said winding roller is pressed against said drum with a substantially greater force than a force that said guiding roller is pressed against said drum.

12. The apparatus in accordance with claim 10, wherein said movable unit presses said winding roller against said drum by a weight of the movable unit, said pivoting arm pressing said guiding roller against said drum by a weight of the pivoting arm, a pressing force by said movable unit being substantially greater than a pressing force by said pivoting arm.

13. The apparatus in accordance with claim 10, further comprising a biasing means for biasing said pivoting arm toward said drum.

14. The apparatus in accordance with claim 10, wherein said movable unit includes a pivotable winding arm, said winding roller being provided on said winding arm.

15. The apparatus in accordance with claim 10, further comprising:

a second arm pivotably disposed with respect to said pivoting arm; and an additional guiding roller pressing said tape against the outer circumferential surface of said drum, wherein said second arm is provided with the additional guiding roller.

16. The apparatus in accordance with claim 10, further comprising a detector detecting an end area of said tape, said detector using an area different from an area with which said winding roller and said guiding roller are brought in contact with the tape so as to detect said end area.

17. The apparatus in accordance with claim 16, wherein said tape has light transmissivity in the end area substantially lower than the light transmissivity in another area, said detector including an optical sensor using a transmissivity of light penetrating said tape to sense the end area.

* * * * *